US010118871B2

(12) United States Patent
Bley et al.

(10) Patent No.: US 10,118,871 B2
(45) Date of Patent: Nov. 6, 2018

(54) IGNITION SETS WITH IMPROVED IGNITION PERFORMANCE

(75) Inventors: Ulrich Bley, Fürth (DE); Peter Simon Lechner, Oberasbach (DE)

(73) Assignee: RUAG AMMOTEC GMBH, Furth (DE)

( * ) Notice: Subject to any disclaimer, the term of this patent is extended or adjusted under 35 U.S.C. 154(b) by 208 days.

(21) Appl. No.: 13/128,116

(22) PCT Filed: Nov. 5, 2009

(86) PCT No.: PCT/EP2009/064677
§ 371 (c)(1),
(2), (4) Date: Jul. 11, 2011

(87) PCT Pub. No.: WO2010/052269
PCT Pub. Date: May 14, 2010

(65) Prior Publication Data

US 2011/0259484 A1 Oct. 27, 2011

(30) Foreign Application Priority Data

Nov. 7, 2008 (DE) ..... 10 2008 056 437

(51) Int. Cl.
*C06C 7/00* (2006.01)
*C06B 41/10* (2006.01)

(52) U.S. Cl.
CPC ..... *C06C 7/00* (2013.01); *C06B 41/10* (2013.01)

(58) Field of Classification Search
CPC ..... C06B 25/00; C06B 25/04; C06B 33/08; C06B 45/00
See application file for complete search history.

(56) References Cited

U.S. PATENT DOCUMENTS

| | | | | |
|---|---|---|---|---|
| 3,159,512 | A * | 12/1964 | Von Herz | C06B 41/02 149/105 |
| 5,549,769 | A | 8/1996 | Ramaswamy | |
| 6,165,294 | A * | 12/2000 | Fogelzang et al. | 149/23 |
| 6,964,287 | B1 * | 11/2005 | Nesveda | C06C 7/00 149/108.6 |
| 2001/0001970 | A1 | 5/2001 | Hagel et al. | |
| 2005/0067073 | A1 | 3/2005 | Hael et al. | |
| 2005/0098248 | A1 | 5/2005 | Khovonskov et al. | |
| 2005/0183805 | A1 * | 8/2005 | Pile et al. | 149/39 |

FOREIGN PATENT DOCUMENTS

| | | | |
|---|---|---|---|
| DE | 196 16 627 | A1 | 11/1997 |
| DE | 199 12 622 | A1 | 9/1999 |
| EP | 1 443 034 | B1 | 5/2010 |
| WO | WO 2007/071650 | A2 | 6/2007 |

* cited by examiner

*Primary Examiner* — Aileen B Felton
(74) *Attorney, Agent, or Firm* — Fitch, Even, Tabin & Flannery, L.L.P.

(57) ABSTRACT

The invention relates to ignition sets comprising initial explosive substances selected from the group consisting of compounds, in particular compounds of lead, which are derived from trinitropolyphenols, such as trinitrophenol, trinitroresorcinol or hydrazoic acid, for example, in mixture with oxygen-generating substances, wherein further included are initial explosive substances made of alkali metal and/or alkaline-earth metal salts of dinitrobenzofuroxanes and oxygen-generating substances made from nitrates of ammonium, guanidine, aminoguanidine, triaminoguanidine, dicyanodiamidine and from the elements of sodium, potassium, magnesium, calcium, cerium and/or from multivalent metal oxides.

22 Claims, 1 Drawing Sheet

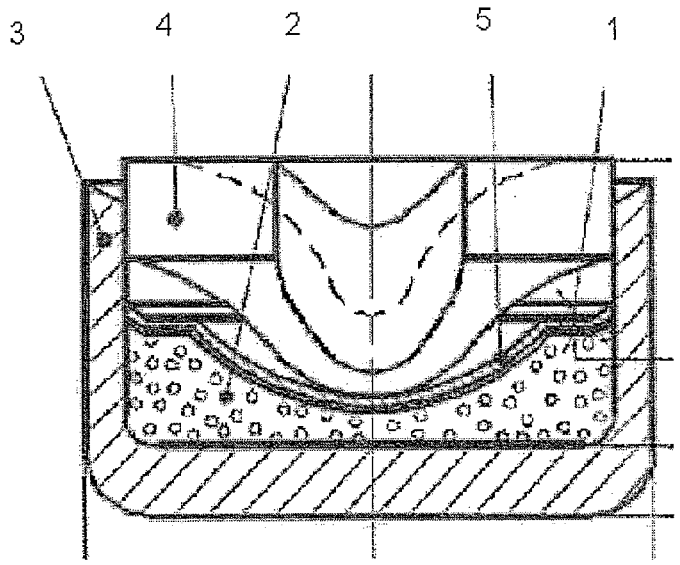
3
4
2
5
1

IGNITION SETS WITH IMPROVED IGNITION PERFORMANCE

The invention relates to priming charges with initial explosives or primary explosives selected from the group consisting of compounds, especially of lead, which derive from trinitropolyphenols, such as, for example, trinitrophenol, trinitroresorcinol, or from hydrazoic acid, in a mix with oxygen generators, which possess an improved ignition performance, especially at low temperatures.

The purpose of the priming charges is to ensure the firing of gunpowders in shooting cartridges and military cartridges. In this context, in all devices with annular or central percussion, under the action of a firing pin, with the aid of an initial explosive, a flame is generated which ignites the propellant charge. Additionally, ignition of the initial explosive may also take place by means of an electrically generated thermal pulse.

Nowadays, priming charge compositions based on mercury silver fulminate are virtually no longer used, essentially on account of their high toxicity and their lack of thermal stability. They have been replaced by compositions containing lead compounds, antimony compounds, and barium compounds.

U.S. Pat. No. 4,675,059 describes a priming charge which uses diazodinitrophenol as explosive and manganese dioxide as oxidizer.

Known priming charges contain, as initial explosive, compounds, especially of lead, derived from trinitropolyphenols, such as, for example, trinitrophenol, trinitroresorcinol, or from hydrazoic acid. Also known, furthermore, are priming charges which contain double salts of lead—hypophosphite nitrate, for example.

A disadvantage of the known priming charges is that their ignitability decreases sharply at low temperatures, especially below −35° C.

The present invention provides priming charges with initial explosives in a mix with oxygen generators, said priming charges exhibiting enhanced ignitability at temperatures below −35° C. as compared with their known counterparts.

In accordance with the invention the object is achieved by means of priming charges with initial explosives selected from the group consisting of compounds, especially of lead, which derive from trinitropolyphenols, such as, for example, trinitrophenol, trinitroresorcinol, or from hydrazoic acid, in a mix with oxygen generators, wherein, additionally, initial explosives comprising alkali-metal salts and/or alkaline-earth-metal salts of dinitrobenzofuroxanes, and the oxygen generators comprising nitrates of ammonium, guanidine, aminoguanidine, triaminoguanidine, dicyanodiamidine and also the elements sodium, potassium, magnesium, calcium, cerium and/or polyvalent metal oxides, are included.

The priming charges of the invention have an improved ignitability at temperatures below −35° C., especially down to −54° C., in comparison with the prior art.

BRIEF DESCRIPTION OF DRAWING

FIG. 1 illustrates a schematic construction of an anvil primer cap.

In accordance with the invention, the initial explosives are used preferably in a total fraction of 30% to 60% by weight, based on the overall mixture.

As oxygen generators it is possible, in addition to the metal peroxide zinc peroxide, known per se from the prior art, to use other oxygen generators as well. Further generators in this sense that may be used in the priming charge include, for example, the following: lead dioxide, tin dioxide, cerium dioxide, tungsten trioxide and/or nitrates of ammonium, guanidine, aminoguanidine, triaminoguanidine, dicyanodiamidine, and also the elements sodium, potassium, magnesium, calcium, cerium, especially potassium nitrate or basic cerium nitrates. The amount of oxygen generators in the priming charges of the invention may vary between 40% and 70% by weight, based on the overall mixture. Particularly preferred for the purposes of the invention is an amount of 5%-40% by weight of potassium dinitrobenzofuroxanate as further initial explosive. The generator may be used both in fine-grain state and also in coarsely granular form. Fine-grained substances having an average grain size of approximately 10 μm are used preferably when the priming charges are used in the form of pressed charges, while coarsely granular substances having a grain size of about 30 μm are particularly suitable for less highly compacted charges, as for example in rimfire rounds.

In accordance with the invention, the priming charges may further contain sensitizers, reducing agents, friction agents, secondary explosives and/or inert substances.

Where sensitizers are present, preferably tetrazene, it is possible for fractions of 0% to 10% by weight to be present, based on the overall mixture.

Reducing agents, which make a contribution to the reaction, are suitable in the priming charges of the invention for improving the ignition capacity, and in some cases also have an effect of increasing the mechanical sensitivity. Suitable substances are preferably selected from carbon and/or metal powders, especially of boron, aluminum, cerium, titanium, zirconium, magnesium, and silicon, metal alloys, especially cerium-magnesium, cerium-silicon, titanium-aluminum, aluminum-magnesium, calcium silicide and metal sulfides, especially antimony sulfide and molybdenum sulfide, and also metal hydrides, as for example titanium hydride, especially in a fraction of 0% to 10% by weight, based on the overall mixture. Some reducing agents may at the same time also fulfill the function of a friction agent, such as, for example, antimony sulfides or calcium silicides. While the fraction of the reducing agents in the priming charge may be 0% to 10% by weight, friction agents, which participate in the reaction during combustion, may be present in amounts of up to 15% by weight, based on the overall mixture, in the priming charges of the invention.

Suitable further components which make a contribution to the reaction include, especially, secondary explosives, such as, for example, nitrocellulose or pentaerythritol tetranitrate. Further examples include octogen and hexogen, and also amino compounds of nitrated aromatics, as for example of trinitrobenzene, such as mono-, di- or triaminotrinitrobenzene, or aminohexanitrobiphenyl, and also the acylation products of these compounds such as, for example, hexanitrooxanilide or hexanitrodiphenylurea. These secondary explosives further include, for example, hexanitrostilbene, hexanitrodiphenyl oxide, hexanitrodiphenyl sulfide, hexanitrodiphenyl sulfone, and hexanitrodiphenylamine, and also tetranitrocarbazole, tetranitroacridone or polyvinyl nitrate, and also nitrotriazolone and its compounds. The fraction of these substances in the priming charge may be 0% to 30% by weight, based on the overall mixture.

Suitable inert substances in the priming charges of the invention include conventional substances, which are often also used for tailoring the properties of these charges to the particular end use. Mention may be made here more particularly of binders, adhesives, dyes and passivators, which may be present preferably in a fraction of 0% to 20% by weight, based on the overall mixture. Examples here include calcium carbonate, titanium dioxide and/or white boron nitride.

The priming charges of the invention are produced by conventional methods, by sieving of the dry mixture or kneading of the water-moist mixture. The metering of the water-moist composition can be accomplished by coating of the perforated plates or by extrusion.

It has surprisingly been found that, by addition of potassium dinitrobenzofuroxanate to well-known priming charge formulations based on lead trinitroresorcinate, the ignition performance, especially at low temperatures, is significantly increased, and this significantly expands the scope for use of cartridges of different caliber.

EXAMPLES

Table 1 sets out, first, the conventional SINOXID priming mix (comparative example), and the mixture 1, which is enriched with potassium dinitrobenzofuroxanate.

| | Comparative example | Example 1 |
|---|---|---|
| Lead trinitroresorcinate | 38% | 30% |
| Potassium dinitrobenzofuroxanate | 0% | 15% |
| Tetrazene | 3% | 4% |
| Barium nitrate | 38% | 35% |
| Lead dioxide | 5% | 6% |
| Calcium silicide | 11% | 5% |
| Titanium | 5% | 5% |

From these two example charges, anvil primer caps with a charge mass in each case of around 38 mg were produced. The schematic construction of an anvil primer cap of this kind is shown in FIG. 1 and is explained in more detail below.

The anvil primer cap (1) contains the priming charge (priming mix) (2) in a cup-shaped outer shell (3) of copper or of copper alloy. The opening in the cup-shaped outer shell (3) is sealed with an anvil plate (4), the hollow, conical dome of the anvil plate (4) pointing in the direction of the priming charge (2). Disposed between the priming charge (2) and the anvil plate (4) is a separating layer (5).

The anvil primer caps were processed identically into 338-caliber cartridges (see Table 2), conditioned at −54° C. for 4 hours, and investigated in a standard experimental setup for maximum pressure and projectile velocity. In these investigations, surprisingly, a significantly lower firing delay (t2) is found for the anvil primer caps processed using example mixture 1, at temperatures of −54° C., as shown in Table 2.

TABLE 2

Overview of ballistics results at −54° C.

| | Comparative example | Example 1 |
|---|---|---|
| Propellant charge powder type | N165 | N165 |
| Mass | 5.835 g | 5.835 g |
| Number of shots | 10 | 10 |
| Maximum pressure | | |
| Average | 3398 bar | 3077 bar |
| Minimum | 3252 bar | 2939 bar |
| Maximum | 3579 bar | 3267 bar |

TABLE 2-continued

Overview of ballistics results at −54° C.

| | Comparative example | Example 1 |
|---|---|---|
| Projectile velocity | | |
| Average | 819.7 m/s | 803.1 m/s |
| Minimum | 810.7 m/s | 793.2 m/s |
| Maximum | 828.8 m/s | 815.8 m/s |
| Firing delay time (t2) | | |
| Average | 10.70 ms | 1.08 ms |
| Minimum | 1.84 ms | 0.93 ms |
| Maximum | 36.49 ms | 1.26 ms |

The invention claimed is:

1. Priming charges with initial explosives selected from the group consisting of compounds derived from trinitropolyphenols or hydrazoic acid in a mix with oxygen generators, characterized in that, additionally, initial explosives comprising alkali-metal salts and/or alkaline-earth-metal salts of dinitrobenzofuroxanes are included in an amount of 5%-15% by weight based on the overall mixture, wherein the oxygen generators consist of at least one selected from the group consisting of lead dioxide, cerium dioxide, and nitrates of ammonium, guanidine, aminoguanidine, triaminoguanidine, dicyanodiamidine, sodium, potassium, magnesium, barium, calcium, or cerium, and wherein the total amount of the initial explosives is 30% to 60% by weight, based on the overall mixture, and the priming charges are ignitable at temperatures below −35° C. and down to −54° C.

2. Priming charges according to claim 1, characterized in that the amount of the oxygen generators is 40% to 70% by weight, based on the overall mixture.

3. Priming charges according to claim 1, characterized in that potassium dinitrobenzofuroxanate is included.

4. Priming charges according to claim 1, further including sensitizers, reducing agents, friction agents, secondary explosives and/or inert substances.

5. Priming charges according to claim 4, containing tetrazene as sensitizer in a fraction of 0% to 10% by weight based on the overall mixture.

6. Priming charges according to claim 4, the reducing agents being selected from carbon, metal powders, metal alloys, metal sulfides, and metal hydrides in a fraction of 0% to 10% by weight based on the overall mixture.

7. Priming charges according to claim 4, containing calcium silicide as friction agent in a fraction of 0% to 15% by weight based on the overall mixture.

8. Priming charges according to claim 4, the secondary explosives being selected from hexogen, octogen, and amino compounds of nitrated aromatics in a fraction of 0% to 30% by weight based on the overall mixture.

9. Priming charges according to claim 1, wherein the compounds include lead.

10. Priming charges according to claim 9, wherein the compounds derived from trinitropolyphenols are selected from the group consisting of compounds derived from trinitrophenol and trinitroresorcinol.

11. Priming charges according to claim 6, wherein the metal powders are selected from the group consisting of metal powders of boron, aluminum, cerium, titanium, zirconium, magnesium and silicon; the metal alloys are selected from the group consisting of cerium-magnesium, cerium-silicon, titanium-aluminum, aluminum-magnesium, and calcium silicide; and the metal sulfides are selected from the group consisting of antimony sulfide and molybdenum sulfide.

12. Priming charges according to claim 6, wherein a metal hydride of the metal hydrides is titanium hydride.

13. A priming charge mixture comprising:

initial explosives selected from the group consisting of compounds derived from trinitropolyphenols or hydrazoic acid;

additional initial explosives selected from the group consisting of alkali-metal salts of dinitrobenzofuroxanes and alkaline-earth-metal salts of dinitrobenzofuroxanes, the additional initial explosives being included in an amount of 5%-15% by weight of the mixture; and oxygen generators, wherein the oxygen generators consist of at least one selected from the group consisting of lead dioxide, cerium dioxide, and nitrates of ammonium, guanidine, aminoguanidine, triaminoguanidine, dicyanodiamidine, sodium, potassium, magnesium, barium, calcium, or cerium, and wherein the total amount of the initial explosives and the additional initial explosives is 30% to 60% by weight, based on the overall mixture, and the priming charge mixture is ignitable at temperatures below −35° C. and down to −54° C.

14. The priming charge mixture according to claim 13, wherein the compounds include lead.

15. The priming charge mixture according to claim 13, wherein the mixture includes potassium dinitrobenzofuroxanate in an amount of 5%-15% by weight of the mixture.

16. The priming charge mixture according to claim 13, further comprising at least one component selected from the group consisting of sensitizers, reducing agents, friction agents, secondary explosives, and inert substances.

17. The priming charge mixture according to claim 13, wherein the compounds derived from trinitropolyphenols are selected from the group consisting of compounds derived from trinitrophenol and trinitroresorcinol.

18. Priming charges according to claim 1, wherein the initial explosives comprise compounds derived from trinitrophenol and trinitroresorcinol.

19. The priming charge mixture according to claim 13, wherein the initial explosives comprise compounds derived from trinitrophenol and trinitroresorcinol.

20. Priming charges according to claim 1, wherein the initial explosives comprise potassium dinitrobenzofuroxanate in an amount of 5%-15% by weight based on the overall mixture, and lead trinitroresorcinate.

21. Priming charges according to claim 1, wherein the oxygen generators have an average grain size of about 10 μm to about 30 μm.

22. The priming charge mixture according to claim 13, wherein the oxygen generators have an average grain size of about 10 μm to about 30 μm.

* * * * *